US006155411A

United States Patent [19]

Ho

[11] Patent Number: 6,155,411

[45] **Date of Patent: *Dec. 5, 2000**

[54] CONTAINER

[75] Inventor: Stanley Ho, Warren, N.J.

[73] Assignee: Allure Home Creation Co., Inc., Boonton, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/165,064

[22] Filed: Oct. 2, 1998

[51] Int. Cl.[7] ..... B65D 25/20

[52] U.S. Cl. ..... 206/77.1; 206/217; 206/362.2; 206/457; 220/574; 220/908; 222/78; 428/13; 446/267

[58] Field of Search ..... 206/217, 457, 206/77.1, 362.2, 362.3; 215/400; 220/662, 574, 908; 222/78; 273/457; 428/13, 14, 16; 446/75, 267

[56] References Cited

U.S. PATENT DOCUMENTS

| | | | |
|---|---|---|---|
| Re. 23,612 | 1/1953 | Abel | 428/13 |
| 4,928,412 | 5/1990 | Nishiyama | 446/267 |
| 4,941,590 | 7/1990 | Pantaleo et al. | 220/662 |
| 5,377,824 | 1/1995 | Seymour | 206/209.1 |
| 5,603,176 | 2/1997 | Eddins et al. | 428/13 |

FOREIGN PATENT DOCUMENTS 2752690 3/1998 France .

OTHER PUBLICATIONS

Colored photograph of a front view of a pump device.
Colored photograph of a back view of a pump device.
Colored photograph of a side view of a pump device.
An invoice (and attachment, total of 4 pages) indicating the date shipped as Nov. 18, 1997 for a pump device shown in the three photographs.

*Primary Examiner*—Jim Foster
*Attorney, Agent, or Firm*—Frommer Lawrence & Haug LLP

[57] ABSTRACT

Disclosed and claimed is a container, such as a tumbler, a toothbrush holder, a garbage pail, a soap dish, a pitcher, or a bowl, which is affixed to a sealed vessel containing a first liquid, a second liquid, at least one structure, wherein the structure is insoluble in both the first and the second liquids and floats on the first liquid, the first and the second liquids are immiscible, the first and the second liquids have densities such that the first liquid is beneath the second liquid, the volume of the second liquid is greater than the volume of the first liquid, the first liquid, or the second liquid or both of the first and the second liquids are optionally-colored and methods for making and using the container. The structure suspended in the sealed vessel is weighted so it can maintain its upright configuration irrelevant to the position of the sealed vessel.

28 Claims, 9 Drawing Sheets

CONTAINER

RELATED APPLICATIONS

Reference is made to U.S. patent application Ser. No. 08/844,225, filed Apr. 18, 1997, which claims priority from Taiwanese Patent Application No. 86200066, filed on Jan. 15, 1997 and Chinese Patent Application No. 97204313.7, 1997, filed on Feb. 3, 1997 and U.S. Provisional Patent Application Ser. No. 60/089,873 filed Jun. 19, 1998, converted to a utility patent application on Jun. 17, 1999, U.S. Ser. No. 09/334,806, now U.S. Pat. No. 6,105,819, all of which are incorporated herein by reference.

FIELD OF THE INVENTION

The present invention relates to a container for holding goods. The container can be for a liquid, such as a tumbler, or a pitcher; for instance, a container for consumable liquids, or the like. The container can also be for a solid, or for solids with liquids optionally present, such as a soap dish (the soap can be solid, but when wet may have some liquid associated with it), a wastebasket (which can hold a solid waste item and/or a liquid waste, such as paper and/or plastic), a bowl (e.g. to hold food and/or drinks, or other items one would store in a bowl), or a toothbrush holder to hold toothbrushes, or the like.

The container can be sized as desired; for instance to suit the purpose of the container. For example, the container may be sized so it is suitable for display on a shelf or a sink (e.g., a bathroom sink when it is a toothbrush holder or soapdish), or for use in the home to entertain guests (e.g., when it is a tumbler or bowl), or sized to be in a corner in a home or office (e.g., when it is a wastebasket). For instance, it can have a diameter of about four inches and a height of about seven inches when used as a tumbler.

The container includes an open vessel and a decorative vessel. The open vessel is to contain liquids and/or solids or has means for receiving solids. The decorative vessel can be hollowed and can be positioned either below or above the open vessel. The open vessel can be refillable. The decorative vessel can contain a three-dimensional insoluble decorative structure or sculpture and/or two immiscible fluids each having a different density. When present, the three-dimensional insoluble structure is capable of being suspended and floats on top of one of the two immiscible liquids.

Thus the invention can relate to a container comprising a first open vessel and a second sealed vessel. The second vessel contains two immiscible liquids such having densities that one liquid sits atop the other, e.g., the lower liquid can occupy from ⅛ to about ⅓ the volume of the second vessel. The second vessel can be a top or closure for the first vessel, either removable therefrom or affixed thereto; or, the second vessel can be a base attached to the first vessel. The second vessel can contain at least one sculpture, insoluble in the liquids, preferably somewhat weighted, so it floats on one liquid and is immersed in the other liquid within the second vessel. Either or both of the liquids can be colored, and the sculpture can be decorative.

Documents cited in the following text are incorporated herein by reference.

BACKGROUND OF THE INVENTION

Containers for liquids and/or solids are varied. A consumable liquid such as soup, soft drinks, water, coffee, tea or the like may be contained in an open-mouthed container such as a cup. But, open-mouth containers are not aesthetically pleasing, and normally does not provide the stability desired.

A sealed container containing two immiscible liquids, one or both of which is optionally colored is known; for instance, a "wave" device which pivots back and forth generates the appearance of a wave. In addition, it is also known in the art to suspend and/or dispose a three-dimensional sculpture atop one of the two immiscible fluids. Such container is commonly shaped as a paper weight. However, it is believed that heretofore a tumbler and/or a container has not been combined with such sealed container.

Presently available containers for either liquid and/or solids are predominantly an open-mouth container which do not provide features that stabilizes the basis of the containers in order to prevent the container from tipping over. In addition, the available containers do not also provide an aesthetically pleasing base or top which creates an aquatic motif.

Reference is made to Taiwanese laid-open publication No. 340349 laid open on Sep. 11, 1998, which is believed not to disclose or claim the present invention.

OBJECTS AND SUMMARY OF THE INVENTION

An object of the invention may include any of:

providing a novel container; providing a container which in certain embodiments may be refillable, providing a container which permits a wide range of design possibilities not dictated by the function of the container; providing a container which is suitable for holding any consumable hot and/or cold and/or lukewarm liquids, such as milk, water, soft drinks, coffee, tea, soup or the like, or for holding any solids such as a toothbrush, soap, paper, plastic, solid food or the like; providing a container which is aesthetically pleasing and thus encourages the user to refill and reuse it and thereby provide an environmental benefit; and, providing a container having a hollow decorative vessel capable of containing a three dimensional ornamental sculpture disposed in two immiscible liquids which, for example, can resemble an aquatic motif.

The invention provides a container comprising a first vessel and a second vessel. The first vessel is hollow and open and the second vessel is hollow and sealed. The second vessel contains two immiscible liquids; the liquids have densities such that one liquid sits atop the other. The lower liquid can occupy from about ⅛ to about ½, e.g., about ⅛ to about ⅓ the volume of the second vessel.

The second vessel can be a top or closure for the first vessel, either removable therefrom or affixed thereto; or, the second vessel can be a base attached to the first vessel. The second vessel can contain at least one sculpture, insoluble in the liquids, preferably somewhat weighted, so it floats on one liquid and is immersed in the other liquid within the second vessel. Either or both of the liquids can be colored, and the sculpture can be decorative. If a removable top, the second vessel can snap on or screw into the first vessel.

Thus, the invention can provide a container comprising a first vessel and a second vessel, wherein the first and second vessels are connected, the first vessel comprises means for containing desired goods in its interior, and the second vessel comprises a hollow decorative vessel comprising means for permitting a user to view a sculpture within its interior.

The first vessel can comprise an open mouth and may or may not have a removable cover. The contents contained in the first vessel can be dispensed from by way of pouring. The removable cover can be a snap-on type cover (with a receiving portion for the cover on the open mouth bottle), or a threaded cap (with mating threads on the open mouth bottle). Thus, as can be understood from this description, the vessels can be any desired shape.

The second vessel can contain at least two different immiscible liquids. The liquids have densities such that one sits atop the other. The second vessel can optionally contain particles capable of being temporarily in suspension when the liquids in the second vessel is shaken or agitated.

The second vessel preferably contains at least one sculpture, insoluble in the liquids, and somewhat weighted so it floats on the lower liquid and is within the upper liquid. Either or both the liquids can be colored. The liquids preferably fill the second vessel.

The container can comprise means for receiving that which is to be contained, e.g., a solid or liquid, or both, i.e., the container has a means defining an opening in an interior open space in the first vessel for receiving and holding that which is to be contained.

The container can be constructed such that the first vessel is positioned below the second vessel, and optionally serves to display the aesthetic sculpture suspended in the second vessel; e.g., the second vessel can be a lid or top or closure for the first vessel.

The first vessel can be any desired color, as can the second vessel; e.g., the second vessel or the first can be translucent or frosted.

The container can also be constructed such that there are means for permitting a user to view a sculpture within the second vessel by viewing discrete portions of the interior of the second vessel, i.e., the second vessel can have discrete portions which prohibit viewing the contents of the second vessel. In other words, the second vessel can be selectively clear or transparent or translucent or selectively colored or frosted.

The first vessel can be refillable or replaceable.

The insoluble three-dimensional sculpture suspended within the decorative vessel could take the shape of a fish, a frog, a boat, a duck, a turtle, a swan, a dolphin, a penguin and the like. There is preferably at least one insoluble three-dimensional sculpture and each is preferably weighted at the bottom as to provide, ensure and maintain an upright position irrelevant to the position of the decorative vessel.

When the second vessel is a base for the first vessel, it helps to support the container.

The invention also provides a container comprising a hollow decorative vessel capable of containing two immiscible liquids having the insoluble three-dimensional sculpture suspended and afloat above one of the liquids and within the other. The vessel has an upper end and a lower end.

The present invention can function as identify the source or origin of the product, to distinguish the product from those of others, and, to convey an image.

The present invention provides a novel container having a second vessel containing a decorative device for displaying an ornamental object and a first vessel for containing any goods which may be either solid and/or liquid.

The invention comprehends methods of making and using the container, e.g., a method for storing a desired item by placing or pouring it into an inventive container.

These and other objects and embodiments of the invention are provided in, or are obvious from, the following detailed description. Theses drawings are by way of example is by no means limiting to the invention.

BRIEF DESCRIPTION OF THE DRAWINGS

In the following detailed description, reference will be made to the accompanying drawings, wherein.

DETAILED DESCRIPTION

Figure 1:
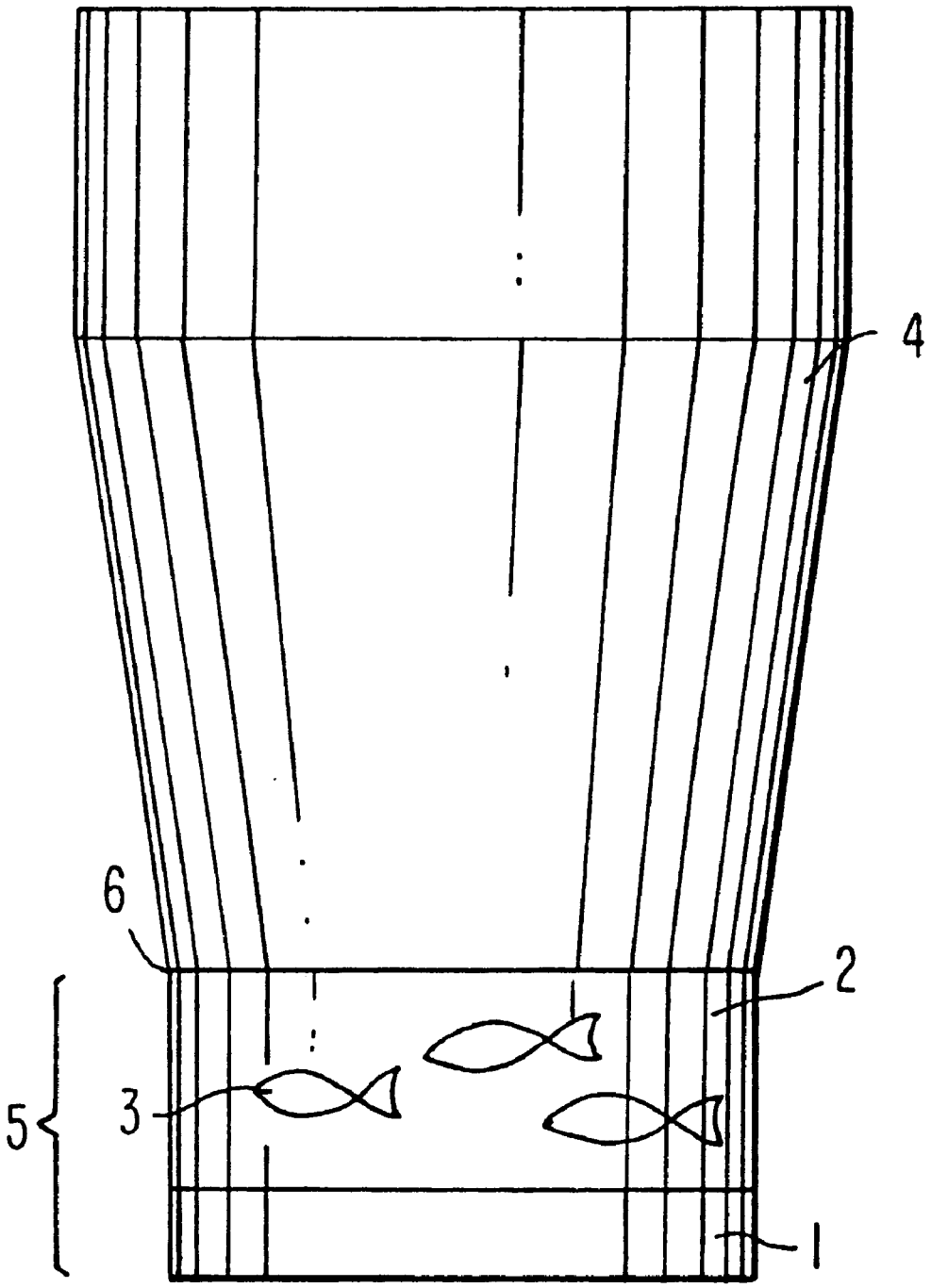
FIG. 1 shows a side view embodiment of a tumbler in accordance of the invention.
Figure 1A:
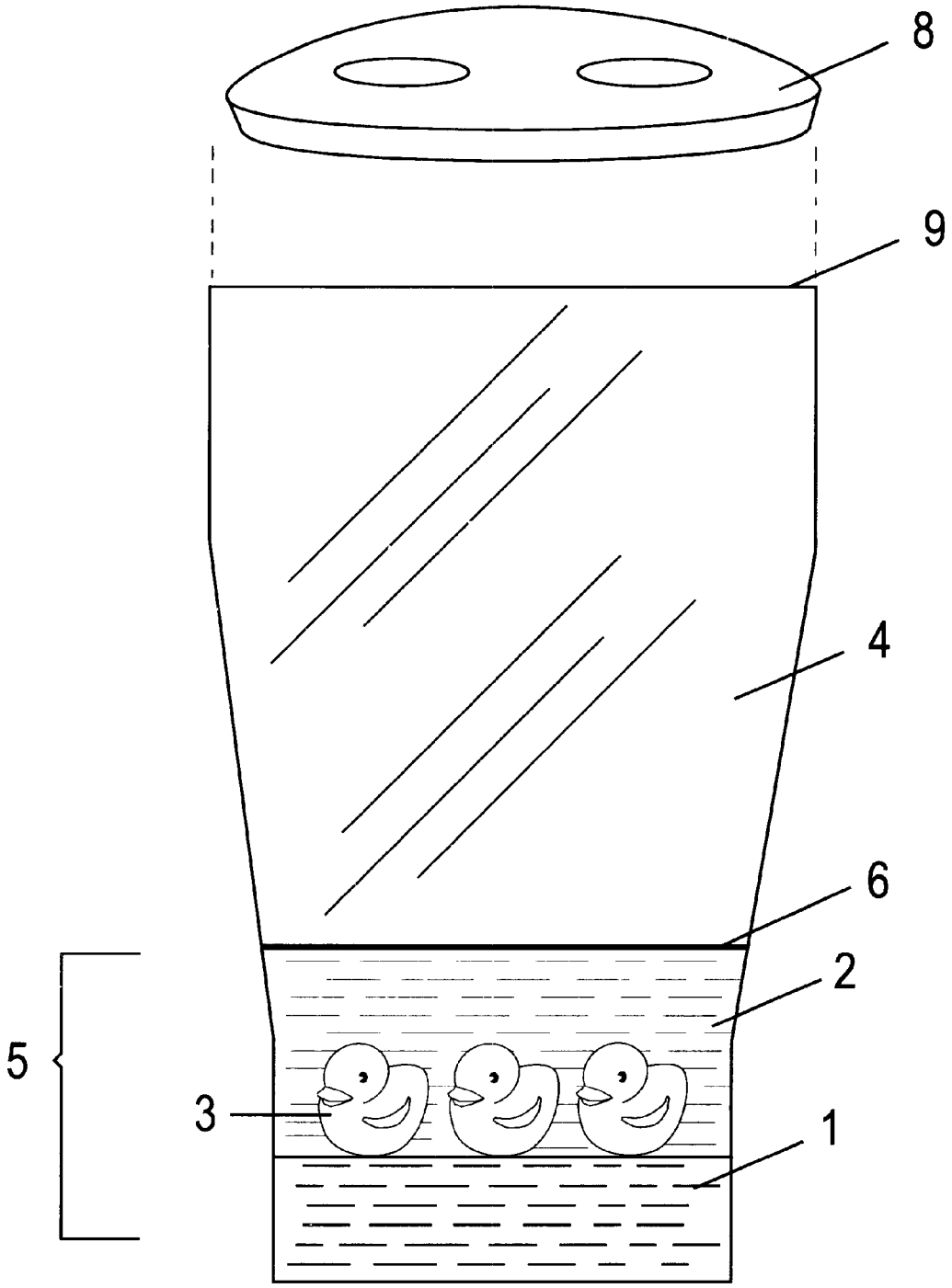
FIG. 1A shows a front exploded view of a container of the invention.
Figure 1B:
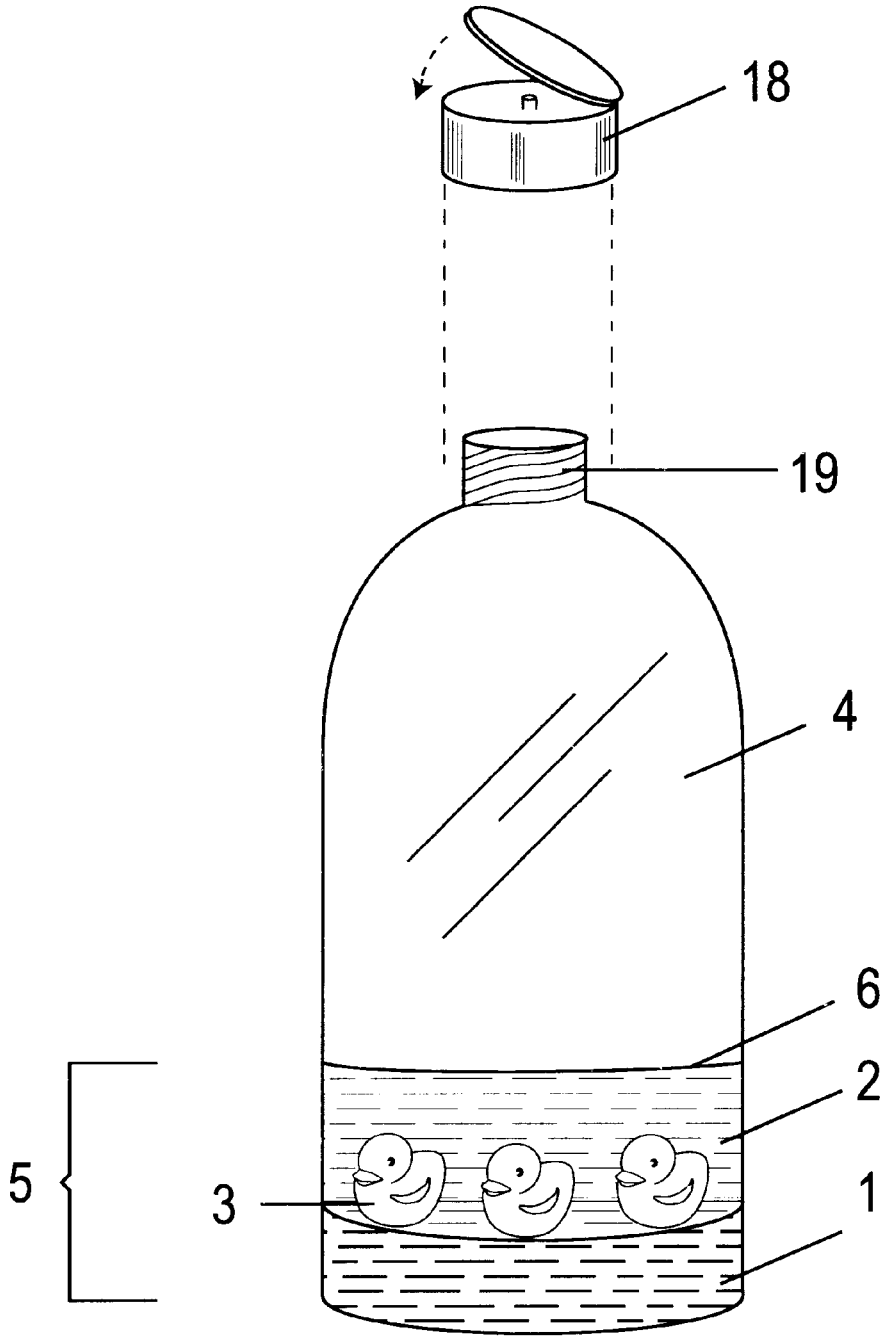
FIG. 1B shows a front exploded view of a container of the invention.
Figure 1C:
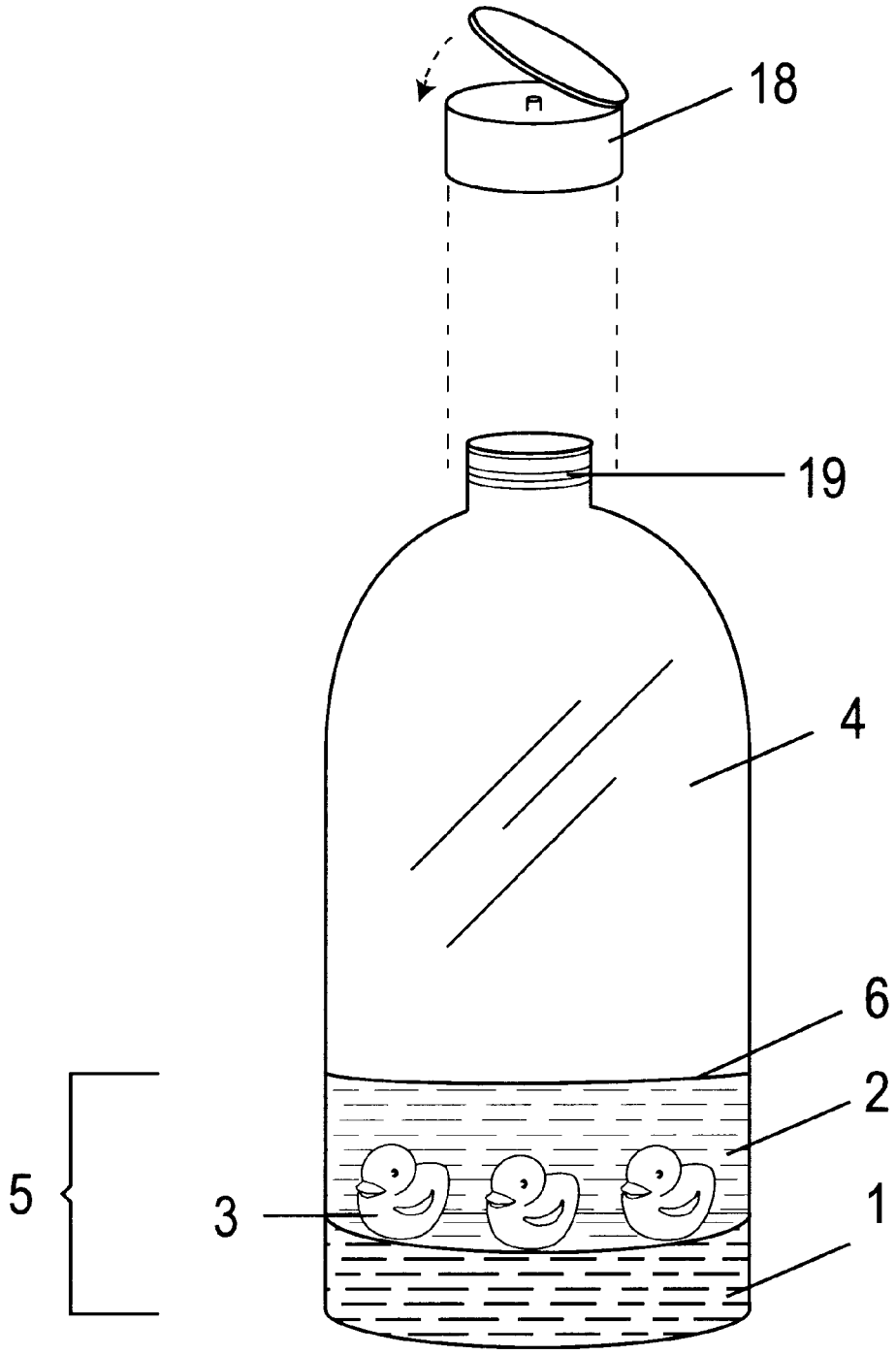
FIG. 1C shows a front exploded view of a container of the invention.
Figure 1D:
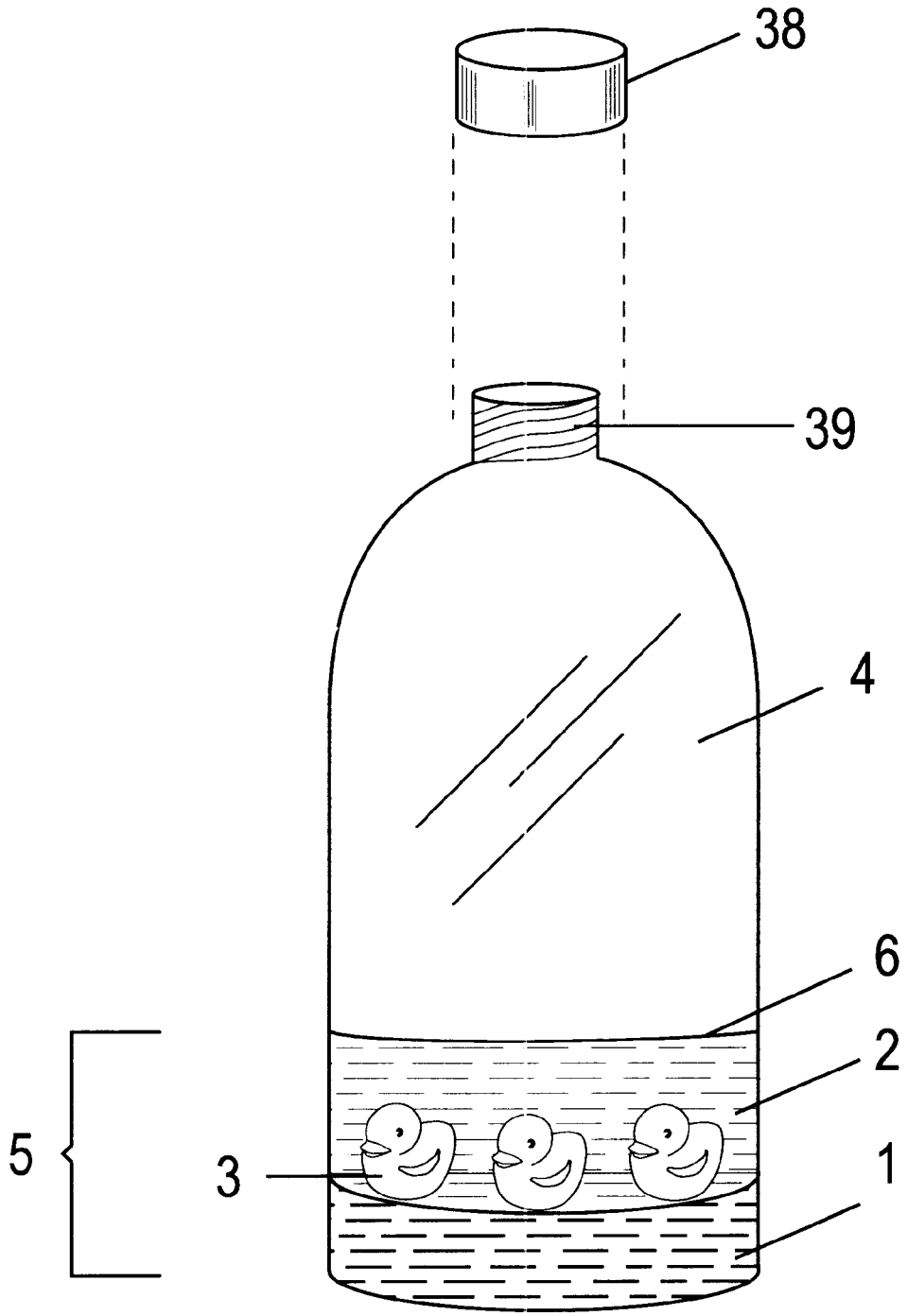
FIG. 1D shows a front exploded view of a container of the invention.
Figure 1E:
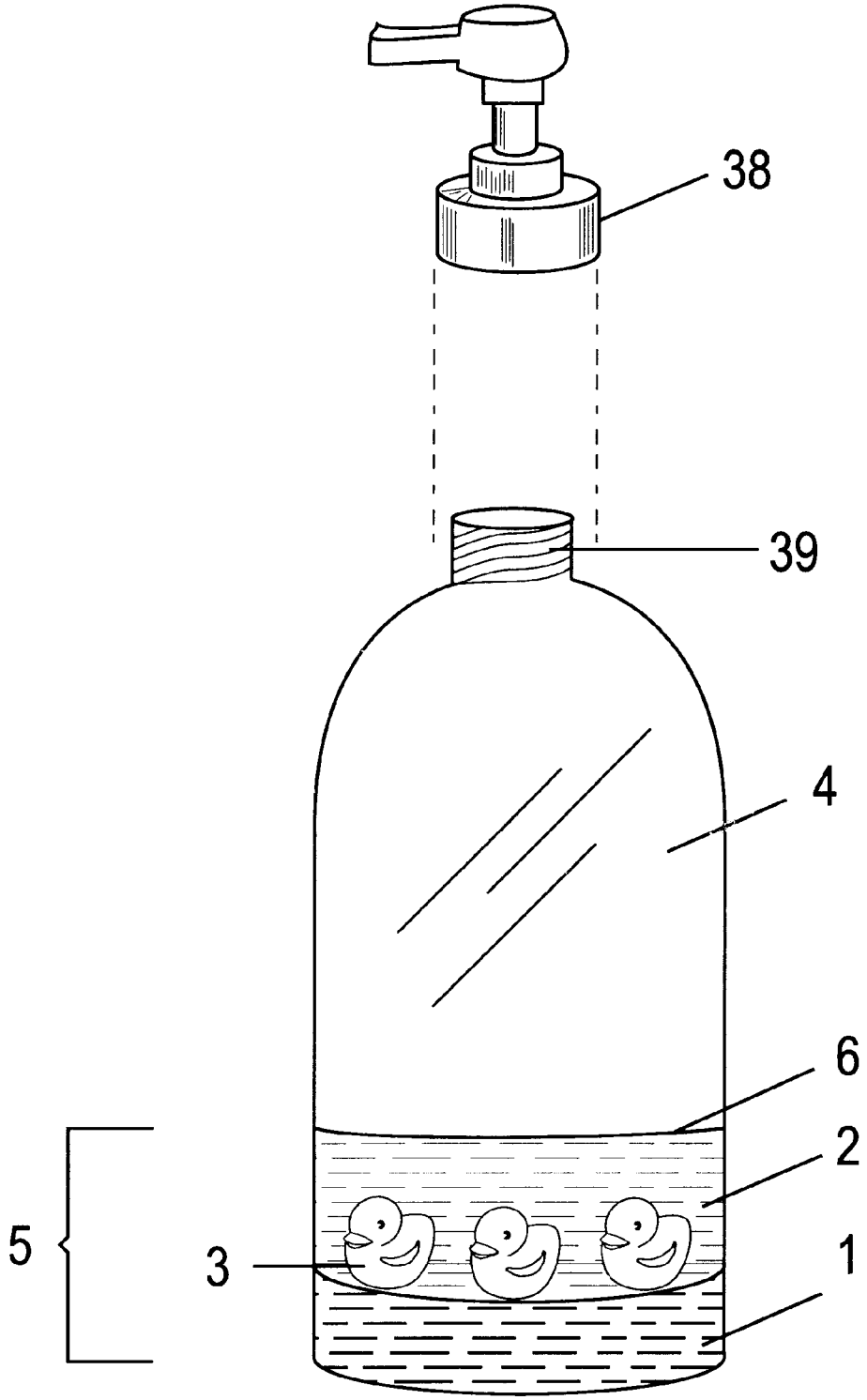
FIG. 1E shows a front exploded view of a container of the invention.
Figure 4:
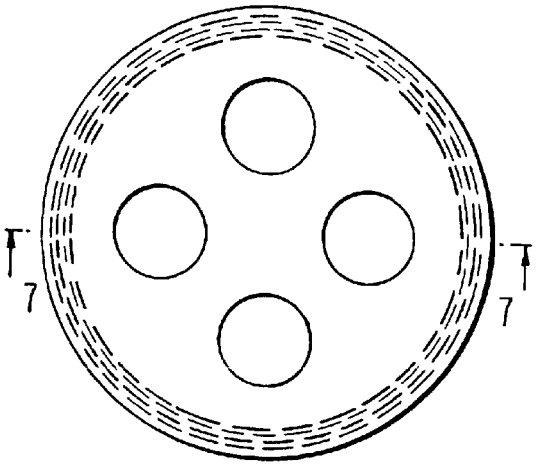
FIG. 4 shows a top view of the tumbler having a porous removable cover to receive a toothbrush with decorative sculptures in liquids of the second vessel.
Figure 3:
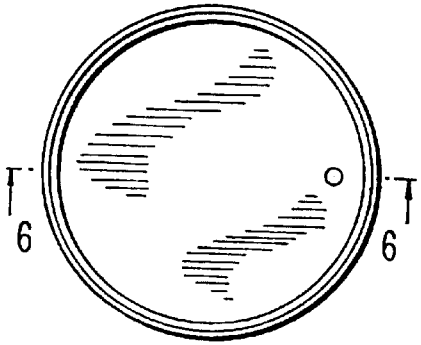
FIG. 3 shows a top view of the tumbler of the invention.
Figure 2:
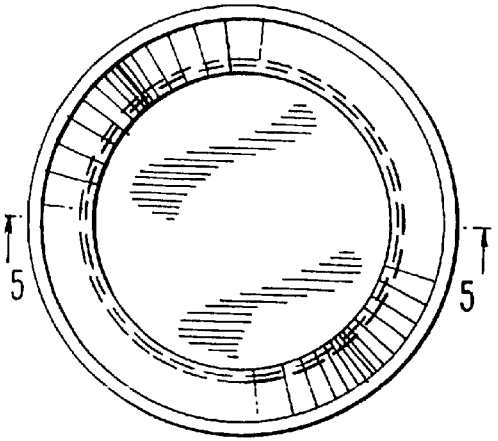
FIG. 2 shows a bottom view of a tumbler of the invention.
Figure 5:
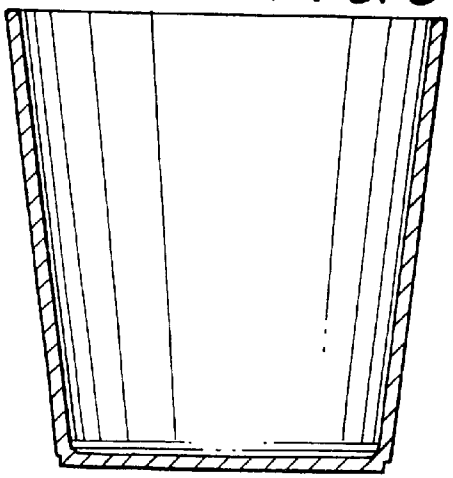
FIG. 5 shows a cross-section view of the first vessel of the tumbler of the invention (along lines A—A of FIG. 2.
Figure 6:
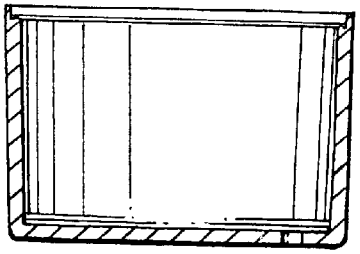
FIG. 6 shows a cross-section view of the sealed second vessel of the tumbler (which can contain the liquids) of the invention (along lines B–B4 FIG. 3)
Figure 7:
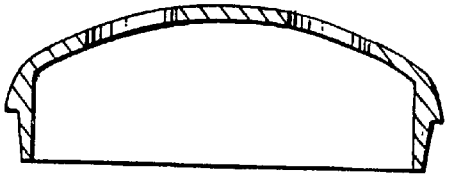
FIG. 7 shows an cross-section view along lines C–C4 of FIG. 4.
Figure 8:
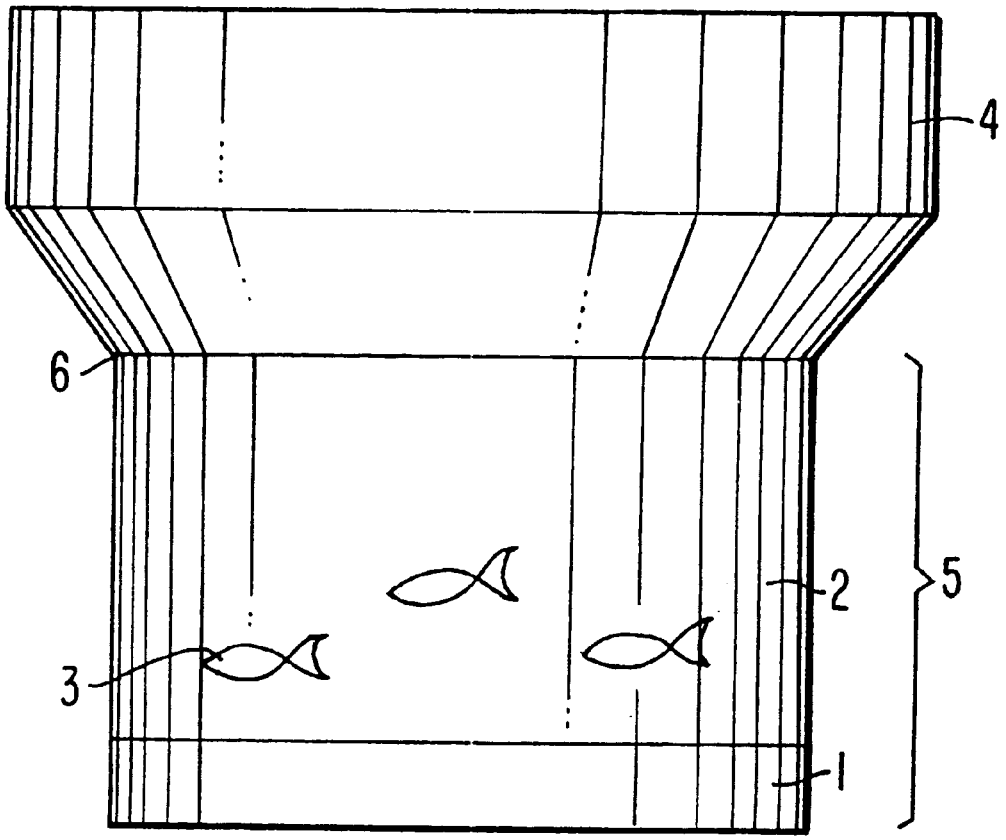
FIG. 8 shows a side view of a soap dish in accordance of the invention.
Figure 11:
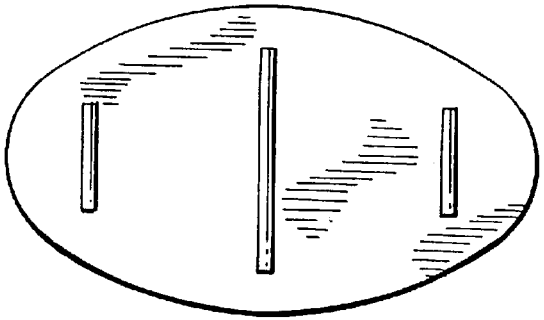
FIG. 11 shows a the top view of the soap dish of the invention.
Figure 12:
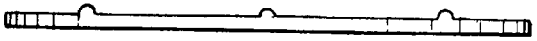
FIG. 12 shows a view of the top of the soap dish of the invention showing ridges for holding soap.
Figure 9:
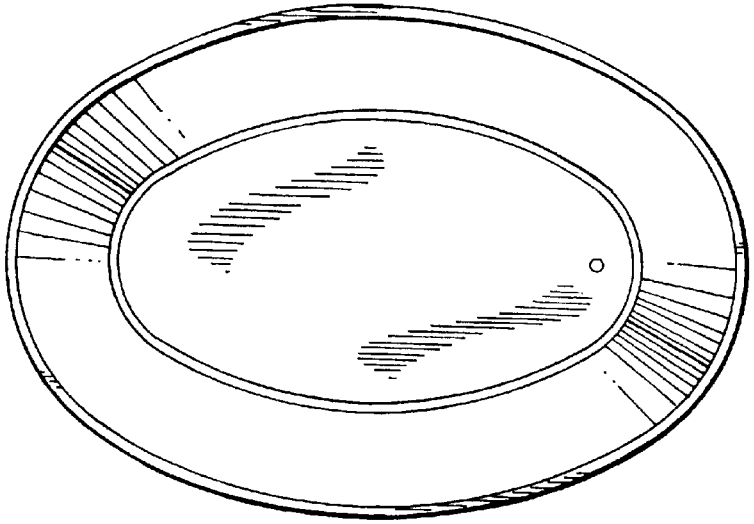
FIG. 9 shows a bottom of the soap dish of the invention.
Figure 10:
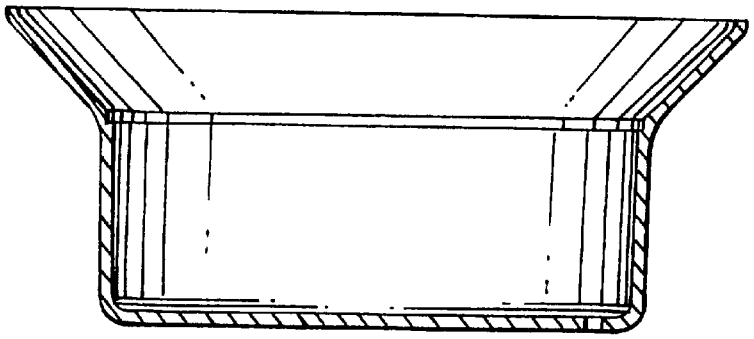
FIG. 10 shows a cross-sectional view of the soap dish of the invention.

Reference is made to all of the Figures wherein as preferred embodiments, containers FIG. 1 and FIG. 8 are illustrated.

As will be appreciated from the following, FIGS. 1 and 8 are containers (FIGS. 2 to 7 show aspects for making the container of FIG. 1 and FIGS. 9–12 show aspects for making the FIG. 8 container). Each has an open vessel 4 atop a sealed vessel 5. The open vessel 4 is connected to the sealed vessel 5.

The sealed vessel 5 can contain a first liquid 1, a second liquid 2, at least one decorative structure 3 suspended and contained within the sealed vessel 5 wherein the first liquid 1, or the second liquid 2 or both the first and the second liquids are optionally-colored, with sealing means 6 between the open vessel 4 and the sealed vessel 5 and the sealed vessel 5 is such that there is substantially no admixture of the content in the open vessel 4 and the first and the second liquids contained within the sealed vessel 5. The decorative structure 3 is weighted as to maintain and ensure an upright configuration and wherein the decorative structure 3 is insoluble in both the first and the second liquids and floats on the first liquid 1 and is within second liquid 2. Thus, containers FIG. 1 and FIG. 8 are aesthetically pleasing containers.

The decorative structure can be a sculpture or other aesthetically pleasing device; or can be a form of advertisement, such as a trademark or logo (which also can be on the face of the first or second vessels).

It is to be further understood that any utilitarian description herein of any component of the container of the invention, is not to be construed as a statement that the appearance of any component of the invention is necessarily only functional in nature. Surface ornamentation or configuration of the container or any components thereof are attributable to ornamental considerations.

Having thus described in detail preferred embodiments of the present invention, it is to be understood that the invention defined by the appended claims is not to be limited to particular details set forth in the above description as many apparent variations thereof are possible without departing from the spirit or scope of the present invention.

What is claimed is:

1. A container comprising a first vessel and a second vessel, wherein the first vessel is hollow with an opening for receiving a solid or a liquid, and removably containing the solid or liquid, and the second vessel is a sealed vessel containing a first liquid, a second liquid, at least one structure, wherein the structure is insoluble in both the first and second liquids, and floats on the first liquid, the first and second liquids are immiscible, the first and second liquids have densities such that the first liquid is beneath the second liquid, and the first vessel is positioned completely above the second vessel, whereby the second vessel is a base support of the container; and, wherein the material of the first vessel is fused with the material of the second vessel.

2. The container of claim 1, wherein the first vessel is annealed to the sealed vessel.

3. The container of claim 1, wherein the structure is decorative.

4. The container of claim 1, wherein the structure is a fish.

5. The container of claim 1, wherein the structure is a turtle.

6. The container of claim 1, wherein the structure is a penguin.

7. The container of claim 1, wherein the structure is a duck.

8. The container of claim 1, wherein the structure is a swan.

9. The container of claim 1, wherein the structure is a dolphin.

10. The container of claim 1, wherein the structure is a sailboat.

11. The container of claim 1, wherein the structure is a frog.

12. The container of claim 1, wherein the first liquid is optionally colored.

13. The container of claim 1, wherein the second liquid is optionally colored.

14. The container of claim 1, wherein the first and the second liquids are optionally colored.

15. The container as claimed in claim 1, wherein the first vessel is a tumbler.

16. The container as claimed in claim 1, wherein the first vessel is a tumbler with a cover capable of receiving a toothbrush.

17. The container as claimed in claim 1, wherein the first vessel is a garbage pail.

18. The container as claimed in claim 1, wherein the first vessel is a soap dish.

19. The container as claimed in claim 1, wherein the first vessel is a pitcher.

20. The container as claimed in claim 1, wherein the first vessel is bowl.

21. The container as claimed in claim 1, wherein the first vessel includes a removable cover.

22. The container as claimed in claim 1, wherein the first vessel containing means defining an opening, and a closure therefor, allowing for filling or refilling of the first vessel.

23. The container as claimed in claim 1, wherein the sealed vessel has a decorative three-dimensional object positioned within it in surrounding relationship to an interior of the sealed vessel.

24. The container of claim 1, wherein the first vessel is welded to the sealed vessel.

25. The container of claim 1, wherein the first vessel is permanently attached to the sealed vessel by way of microwave fusion.

26. The container of claim 1, wherein the first vessel is fused with the sealed vessel by radiowave fusion.

27. The container of claim 1, wherein the first vessel includes a removable cover.

28. A container for holding a toothbrush comprising a first vessel and a second vessel, wherein the first vessel is hollow with an opening for receiving a solid or a liquid, and removably containing the solid or liquid, and the second vessel is a sealed vessel containing:

a first liquid, a second liquid, at least on structure, wherein the structure is insoluble in both the first and second liquids, and floats on the first liquid; the first and second liquids are immiscible; the first and second liquids have densities such that the first liquid is beneath the second liquid;

and the volume of the second liquid is greater than the volume of the first liquid; and the first vessel is positioned completely above the second vessel, whereby the second vessel is base support of the container wherein the first vessel is permanently attached to the sealed vessel and includes a porous removable cover adapted to receive a toothbrush.

* * * * *